United States Patent [19]

van Tongeren et al.

[11] 4,353,005

[45] Oct. 5, 1982

[54] CAMERA TUBE WITH MUTUALLY INSULATED, LIGHT ABSORBING PARTICLES ON GUN SIDE OF TARGET

[75] Inventors: Hendricus F. J. J. van Tongeren; Paulus P. M. Schampers; Willem P. Weijland; Marino G. Carasso, all of Eindhoven, Netherlands

[73] Assignee: U.S. Philips Corporation, New York, N.Y.

[21] Appl. No.: 161,546

[22] Filed: Jun. 20, 1980

Related U.S. Application Data

[60] Division of Ser. No. 16,590, Mar. 1, 1979, Pat. No. 4,251,748, which is a continuation of Ser. No. 780,168, Mar. 22, 1977, abandoned.

[30] Foreign Application Priority Data

Apr. 12, 1976 [NL] Netherlands ..... 7603838

[51] Int. Cl.[3] ..... H01J 29/45; H01J 31/26

[52] U.S. Cl. ..... 313/371; 313/390

[58] Field of Search ..... 313/371, 471, 365, 390, 313/383

[56] References Cited

U.S. PATENT DOCUMENTS

| | | | |
|---|---|---|---|
| 2,869,010 | 1/1959 | Gray | 313/371 |
| 2,908,835 | 10/1959 | Weimer | 313/371 |
| 3,087,985 | 4/1963 | Heijne et al. | 313/371 X |
| 3,475,639 | 10/1969 | Driffort et al. | 313/106 |
| 3,638,060 | 1/1972 | Wacher | 313/112 |
| 3,688,020 | 8/1972 | Kubota | 313/371 X |
| 3,857,037 | 12/1974 | Tomii et al. | 313/371 |

FOREIGN PATENT DOCUMENTS 1067186 5/1967 United Kingdom .

*Primary Examiner*—Robert Segal
*Attorney, Agent, or Firm*—Marc D. Schechter

[57] ABSTRACT

The optical cross talk in a camera tube is reduced by the provision of a filter element which overlaps the entire target. The filter may is be arranged behind the target and is constructed so that it has low reflectance for incoming light. In order to prevent excessive transverse conduction, such a filter has a mosaic structure consisting of mutually insulated areas.

4 Claims, 4 Drawing Figures

CAMERA TUBE WITH MUTUALLY INSULATED, LIGHT ABSORBING PARTICLES ON GUN SIDE OF TARGET

This is a division of application Ser. No. 016,590 filed Mar. 1, 1979, now U.S. Pat. No. 4,251,748, issued Feb. 17, 1981, which is a continuation of Ser. No. 780,168 filed Mar. 22, 1977, now abandoned.

BACKGROUND OF THE INVENTION

The invention relates to a camera tube comprising an entrance window, a photosensitive target which is arranged opposite the entrance window, an electron gun for generating an electron beam for scanning the target, and means for reducing optical cross talk in the target.

A camera tube of this kind is known, for example, from British Patent Specification No. 1,067,186. A camera tube described in this Patent Specification has an anti-halo window for reducing optical cross-talk in the target. Because the major part of the light which is reflected by the target lands outside the target after reflection from the entrance surface of the anti-halo window (due to increased lateral displacement of the light), an anti-halo window of this kind results in a substantial reduction of the optical cross talk. In many cases, particularly in camera tubes with increased red-sensitivity, the effect of the anti-halo window, however, is not completely adequate.

SUMMARY OF THE INVENTION

The object of the invention is to provide a camera tube in which the optical cross talk in the target is reduced to a greater extent than in tubes of known construction. To this end, a camera tube of the kind set forth includes means for reducing the optical cross talk in the target which overlaps at least substantially the entire target surface and reduces either the intensity or the degree of lateral displacement of light which is subject to lateral displacement due to reflections at this area.

In a preferred embodiment of the camera tube in accordance with the invention, the cross talk reducing means comprises a spectrally selective absorbing filter which is arranged, viewed relative to the incoming light, in front of the target and which may be included, for example, in an anti-halo window. A further preferred embodiment of a camera tube in accordance with the invention comprises an absorption filter which is arranged, viewed relative to the incoming light, behind the photosensitive layer of the target. This filter need not be spectrally sensitive.

A further embodiment of a camera tube in accordance with the invention comprises an interference filter with suitable spectral transmission. This filter is arranged between the entrance window and the target at a distance from the target which is small relative to the dimension of the picture elements in the target.

In another preferred embodiment of a camera tube in accordance with the invention, cross talk is reduced by providing the target on a very thin support which is separately mounted in the camera tube.

BRIEF DESCRIPTION OF THE DRAWING

Some preferred embodiments in accordance with the invention will be described in detail hereinafter with reference to the drawing.

DESCRIPTION OF THE PREFERRED EMBODIMENTS

Figure 1:
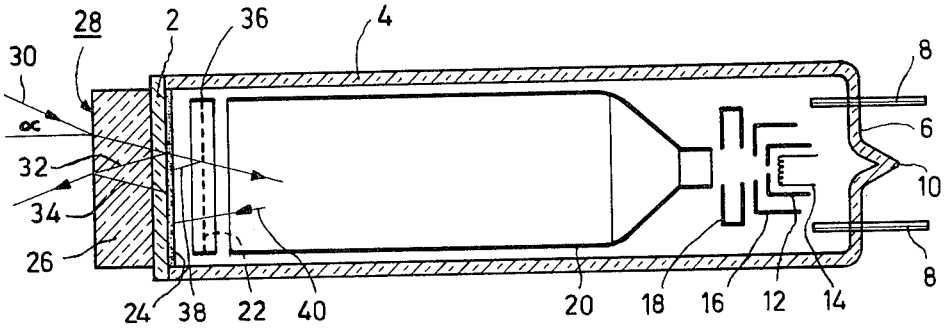
FIG. 1 shows a camera tube in accordance with the invention, comprising an anti-halo window which acts as a selective absorbing filter.

The camera tube shown in FIG. 1 comprises an evelope having an entrance window 2, a cylindrical tube 4 and a tube base 6 with pins 8 and a pumping stem 10. Provided in the envelope is an electron gun having a cathode 12 with a filament 14, a control grid 16, a first anode 18, an output anode 20 and a mesh electrode 22. A photo-sensitive target 24 is preferably arranged on the entrance window and in this embodiment comprises a photoconductive layer or lead monoxide. A signal electrode (not shown) is arranged on a side of the target 24 facing the entrance window 2. Camera tubes of this type are usually provided with an anti-halo window 26. With this arrangement, as a result of the combined large thickness of the entrance window and the anti-halo window, a substantial portion of the light reflected from the target is incident, after subsequent reflection from the entrance face 28 of the anti-halo window, outside the actual target due to the large lateral displacement. This light is thus prevented from disturbing the image. Even though a substantial improvement is thus obtained, in many cases disturbing optical cross talk still occurs, inter alia, due to the fact that the thickness of this additional window may not be large enough so that a part 34 of a light beam 30 can still land on the target after multiple reflections. Part of the incident beam 30 is thus reflected from the target resulting in a beam 32 which is subsequently reflected from the entrance face 28 resulting in beam 34 which strikes the target. In addition a part 38 of the light transmitted by the target can still be intercepted by the target after reflection from the mesh electrode 22, while a part 40 can also be intercepted by the target after reflection from elsewhere in the camera tube, for example, from one of the electrodes of the gun. For the sake of brevity, hereinafter the disturbing light which originates from light initially reflected by the target will be referred to as optical cross talk by reflected light, while disturbing light resulting from light initially transmitted by the target will be referred to as optical cross talk by transmitted light. The invention provides shielding of the target against one of these two types of cross talk separately, or both types simultaneously. The cross talk by reflected light could be reduced by making the anti-halo window slightly absorbing, but the sensitivity of the camera tube would then be reduced. This is often considered unacceptable.

A substantial reduction of the flare is achieved without undesirable loss of sensistivity in accordance with the invention by arranging, between the face of incidence 28 and the target 24, an absorption filter having an absorption which increases from substantially 0% to approximately 100% as the wavelength of the light increases between approximately 0.6 μm and 0.7 μm. It is known that within the visible spectral region, light of short wavelengths is absorbed to a high degree by a lead monoxide layer. Thus, no additional absorption should be introduced for this light. For light with long wavelengths, however, the absorption of such a layer is substantially lower and more of this light will be transmitted as well as reflected. For this spectral region, notably in camera tubes of increased red sensitivity, additional absorption will result in a substantial reduction of the optical cross talk. In camera tubes having an anti-halo window, it is efficient to include the absorbing materials, adapted to the spectral properties of the target, in the glass of this window. Good results have been obtained by means of a mixture of rare earth metals such as, for example, Tm, Nd, Er and Ho. It is to be noted that the spectral sensitivity of this filter requires adaptation to different types of photosensitive layers. A camera tube of the kind set forth usually has an interference filter in the form of a dichroic mirror which is normally provided on the surface 28. This filter is added to adapt the spectral distribution of the light incident on the target to the eye sensitivity curve. An absorption filter in a camera tube in accordance with the invention combines the reduction of the optical cross talk with the adaptation of the spectral sensitivity. Then, in comparison with a camera tube having a dichroic mirror, the sensitivity of the camera tube need not be less. In camera tubes without an anti-halo window, the absorbing materials may be provided in the glass of the entrance window.

In a camera tube with a dichroic filter on the entrance surface of the window, the optical cross talk by reflected light is rather intensified relative to a camera tube without such a filter. This is because a filter of this kind either transmits light of a given wavelength or reflects this light, but does not absorb it. Consequently, a comparatively large part of the light reflected by the target will be subsequently reflected by this filter and return to the target. In an embodiment of a camera tube in accordance with the invention, this drawback is eliminated by arranging the dichroic filter as near to the target as possible rather than on the entrance surface of the camera tube.

Figure 2:
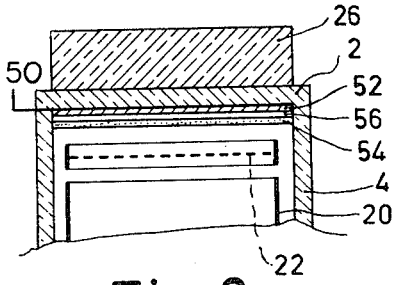
FIG. 2 shows an entrance portion of a camera tube in accordance with the invention, comprising a dichroic filter which is arranged between the target and the entrance window.

FIG. 2 shows an entrance section of a camera tube comprising a dichroic filter 50 which is arranged on an inner surface of an entrance window 2. In a filter of this kind severe requirements are imposed on the thickness of the layers which determine the wavelength, because this thickness amounts to an odd number of half wavelengths in interference filters of this kind, so that the mounting of the filter in a fused tube requires complex precautions for ataining uniform thickness. In camera tubes in which the connection of the entrance window and the cylindrical tube does not require heating of these parts to the softening temperature of the glass, this drawback is eliminated because the filter can be provided on the flat entrance window before it is secured to the cylindrical tube. The filter is preferably arranged directly on the entrance window, followed by the deposition of a signal electrode 56 of tin oxide and/or indium oxide and a photosensitive layer 54. According to this sequence, the photosensitive layer is protected by the signal electrode against any detrimental effects of the filter material. If desired, an additional separating layer 52 can be provided between the signal electrode and the filter for similar reasons. Even though this construction does not reduce reflections, the adverse effects thereof on the picture quality will be much smaller, because the reflections involve a much smaller lateral displacement. From this point of view it is advantageous to use no separating layer or a separating layer which is as thin as possible.

Figure 3:
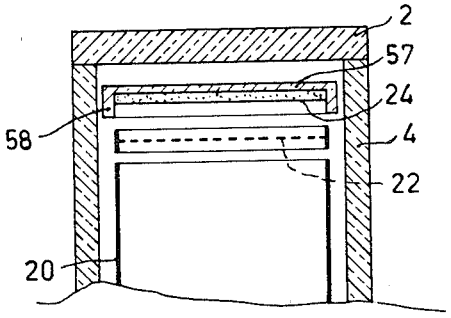
FIG. 3 shows an entrance portion of a camera tube in accordance with the invention, comprising a target which is mounted on a separately arranged support

In an embodiment of a camera tube shown in FIG. 3, the target 24 is arranged on a separate support 57 which is formed, for example, by a plate of mica or a glass foil having a thickness of, for example, from 2 to 50 μm. The support with the target, mounted in a ring 58, is arranged in the tube envelope opposite the mesh electrode 22. Again no reduction of the reflection initially occurs, but because the support is very thin, the lateral displacement is small, so that disturbing optical cross talk is avoided. The distance between the entrance window and the support may be arbitrarily small, provided that no contact is made at any area. In order to prevent light, which is reflected from the target and subsequently from the entrance window, from having a disturbing effect on the picture, the distance between the support 57 and the window 2 is preferably increased to 5 to 10 mm. A dichroic mirror can then also be arranged without objection on the inner or outer surface of the entrance window.

The embodiments described thus far have a common aspect in that initially the detrimental effects of optical cross talk by reflected light are counteracted. Because the filters are also effective against light which has been transmitted twice or more, a given reduction in the flare by transmitted light will also occur.

Figure 4:
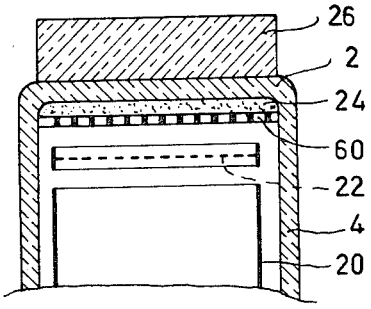
FIG. 4 shows an entrance portion of a camera tube, comprising an absorbing filter which is arranged between the target and the electron gun.

In the preferred embodiment shown in FIG. 4 there is provided a filter which is active particularly for transmitted light. This camera tube comprises a filter 60 which is arranged on the inner side on the target 24. No requirements as regards the spectral sensitivity need be imposed on a filter so arranged. This filter is preferably constructed so that all light is absorbed. Excessive lateral conduction and adverse influencing of the photosensitive layer should be avoided. A filter of this kind may be formed, for example, by a layer of soot consisting of carbon. Alternatively, a filter consisting of a vapor-deposited layer of a noble metal such as silver has also been found to function satisfactorily. In order to minimize the lateral conduction of a filter of this kind, it is advantageous to impart only a limited thickness to the layer or to deposit it via a mask which can, for example, be the mesh electrode. The sealing of a filter thus formed will usually not be 100%, but a substantial reduction of optical cross talk, notably by transmitted light, will thus certainly be achieved. In the case of a transmission of, for example, 20%, secondary incidence, after reflection from the mesh electrode or elsewhere in the camera tube, causes only a negligible part of the light initially transmitted by the target to be transmitted again. An additional advantage of such a filter is that it has been found that a reduction of reflection also occurs for incident light, so that a reduction is also obtained of the flare by reflected light. When a separating layer is added between the target and the filter in order to prevent mutual influence, it should be ensured that this intermediate layer does not cause additional reflection of light incident from the entrance side of the camera tube.

What is claimed is:

1. A camera tube comprising an envelope having an entrance window, a photosensitive target arranged in said envelope at a position such that light passing through said window is incident on a first side of said target, a signal electrode on the first side of the target, and means for producing an electron beam for scanning said target, characterized in that said camera tube further comprises means, disposed on a side of said target opposite said first side, for absorbing light passing through said target, said means having a mosaic structure of mutually insulated areas.

2. A camera tube as claimed in claim 1, wherein said layer comprises carbon soot.

3. A camera tube as claimed in claim 1, wherein said layer comprises a vapor-deposited noble metal having a comparatively low transverse conduction.

4. A camera tube as claimed in claim 3, wherein said metal is silver.

* * * * *